US006581617B2

(12) United States Patent
Ham et al.

(10) Patent No.: US 6,581,617 B2
(45) Date of Patent: Jun. 24, 2003

(54) CANOPY TENT WITH AUTOMATIC UMBRELLA-TYPE COLLAPSIBLE FRAME

(76) Inventors: Se-Il Ham, 102-702 Geumho Apt. 1048 Mansu-Dong Namdong-Gu, Incheon (KR); Gi-Hun Kim, B-302 Hanvit Mansion, 838-8 Sincheon-Dong Siheung-Si, Gyeonggi-Do (KR)

( * ) Notice: Subject to any disclaimer, the term of this patent is extended or adjusted under 35 U.S.C. 154(b) by 0 days.

(21) Appl. No.: 09/872,714

(22) Filed: Jun. 1, 2001

(65) Prior Publication Data

US 2002/0092554 A1 Jul. 18, 2002

(30) Foreign Application Priority Data

Dec. 7, 2000 (KR) ..... 2000-34312

(51) Int. Cl.[7] ..... E04H 15/28

(52) U.S. Cl. ..... 135/135; 135/136; 135/98; 135/156

(58) Field of Search ..... 135/135, 98, 90, 135/21, 147, 99, 156, 136, 124

(56) References Cited

U.S. PATENT DOCUMENTS

| | | | | | |
|---|---|---|---|---|---|
| 48,308 | A | * | 6/1865 | Price | 135/25.3 |
| 321,612 | A | * | 7/1885 | Kuhn | 135/21 |
| 524,535 | A | * | 8/1894 | Steinbach | 135/21 |
| 1,219,847 | A | * | 3/1917 | Nettenstrom | 135/147 |
| 2,227,554 | A | * | 1/1941 | Rordon | 135/16 |
| 5,002,081 | A | * | 3/1991 | Stromeyer | 135/21 |
| 5,230,358 | A | * | 7/1993 | Forell | 135/133 |
| 5,499,646 | A | * | 3/1996 | Lee | 135/121 |
| 6,230,728 | B1 | * | 5/2001 | Reese | 135/127 |

FOREIGN PATENT DOCUMENTS

| | | | | |
|---|---|---|---|---|
| EP | 1162331 | * | 7/2000 | 135/100 |
| FR | 2539600 A | | 7/1984 | |
| GB | 2185273 A | | 7/1987 | |
| JP | 9-144383 A | | 6/1997 | |
| KR | 20-245696 Y | | 8/1999 | |

* cited by examiner

*Primary Examiner*—Lanna Mai
*Assistant Examiner*—Winnie Yip
(74) *Attorney, Agent, or Firm*—Schmeiser, Olsen & Watts LLP

(57) ABSTRACT

A canopy tent with an automatic umbrella-type collapsible frame is disclosed. The frame allows a user to easily, simply and quickly pitch or close the tent, in addition to simplifying its construction. In the collapsible frame (12) of the tent (10), a rib holder (14) rotatably holds the collapsible ribs (24) at its upper end while allowing the ribs to be stretchable in a radial direction when pitching the tent. A stopper (20) is mounted to the lower end of the rib holder (14), while a rope connector (22) is integrally formed at the lower end of the rib holder (14) and is used for holding a tension rope extending from the center of the ceiling part of the tent's canopy. A spreader holder (16) is movably fitted over the shank part of the rib holder (14) such that the spreader holder is movable upward and downward along the shank part. The spreader holder (16) rotatably holds the collapsible spreaders (28) while allowing the spreaders to be stretchable in a radial direction when pitching the tent. An elastic spring (18) is fitted over the shank part of the rib holder (14), and is used for biasing the spreader holder (16) so as to maintain a predetermined gap between the spreader holder (16) and the top end of the rib holder (14) when pitching the tent on a support surface.

7 Claims, 5 Drawing Sheets

CANOPY TENT WITH AUTOMATIC UMBRELLA-TYPE COLLAPSIBLE FRAME

BACKGROUND OF THE INVENTION

1. Field of the Invention

The present invention relates, in general, to canopy tents with automatic umbrella-type collapsible frames designed to be easily and simply stretched or collapsed in the same manner as expected from the collapsible frames of conventional automatic umbrellas, thus allowing a user to easily and simply pitch or close the tent and, more particularly, to a canopy tent with an automatic umbrella-type collapsible frame having a spring fitted over the shank part of the rib holder, the spring having high restoring force and automatically stretching the ribs, thus allowing a user to easily, simply and quickly pitch or close the tent, in addition to simplifying the construction of the frame.

2. Description of the Prior Art

So-called "canopy tents" are designed to be easily, simply and quickly pitched or closed, and so they have been preferably used for outdoor applications, such as during camping or fishing.

Such canopy tents are also so-called "collapsible tents" or "folding tents". The canopy tent has a collapsible frame designed to allow a user to easily, simply and quickly pitch or close the tent on a desired place by stretching or collapsing the frame.

Such canopy tents have been classified into several types. For example, a canopy tent with an automatic umbrella-type collapsible frame has been proposed and used in the prior art. The conventional automatic umbrella-type collapsible frame for such canopy tents is designed to be easily and simply stretched or collapsed in the same manner as expected from the collapsible frames of conventional automatic umbrellas. An example of such conventional automatic umbrella-type collapsible frames for canopy tents is shown in FIG. 6. As shown in the drawing, the conventional automatic umbrella-type collapsible frame for canopy tents comprises a lower shank 110, a rib holder 120, a spreader holder 130, a plurality of collapsible ribs 140 and a plurality of collapsible spreaders 150.

The shank 110 has an internally-threaded opening 111 at its top end, and is selectively connected to an externally-threaded lower end 121 of the rib holder 120 through a screw-type engagement so as to allow the spreader holder 130 to be movable along the shank 110 upward or downward when pitching or closing the tent.

The rib holder 120, selectively connected to the top end of the shank 110 through a screw-type engagement, is provided with a retractable bolt 122 on its shank part for selectively holding the spreader holder 130 on the shank part of the rib holder 120 at a desired position when the tent is completely pitched. A fixed ring is mounted to the top end of the rib holder 120. This fixed ring is regularly toothed on its circumferential surface to form a plurality of rib holding notches 123, with two first projections 124 provided on opposite side surfaces of each notch 123 for holding each of the ribs 140 at the notch 123. A canopy holding disc 125 is mounted to the top surface of the fixed ring of the rib holder 120 using a plurality of locking screws, and holds the canopy to the fixed ring.

The spreader holder 130 is fitted over the shank 110 such that it is movable along the shank 110 and the shank part of the rib holder 120 upward and downward relative to the retractable bolt 122 of the rib holder 120. This spreader holder 130 has a ring, which is provided with the same number of spreader holding notches 132 as that of the rib holding notches 123 of the rib holder 120. Each of the spreader holding notches 132 is provided with two second projections 133 on its opposite side surfaces for holding each of the spreaders 150. The spreader holder 130 is also provided with an actuating button 131 on its shank part. This button 131 is selectively operated by a user to retract the bolt 122 into the shank part of the rib holder 120, and releases the spreader holder 30 from the bolt 122.

The collapsible ribs 140 form the ceiling frame of the tent when the tent is fully pitched on a support surface, and are provided with inclined slits 141 at their inside ends. The ribs 140 are thus hinged to the projections 124 formed in the rib holding notches 123 of the rib holder 120. The ribs 140 are rotatable around the projections 124 in opposite directions when the tent is pitched or closed. The outside ends of the ribs 140 are provided with spreader connectors 142 for connecting the spreaders 150 to the ribs 140. An extension 140*a* is connected to each of spreader connectors 142. These extensions 140*a* form the sidewall frame of the tent when the tent is fully pitched on a support surface.

The collapsible spreaders 150 are hinged to the projections 133 formed at the notches 132 of the spreader holder 130. When the tent is fully pitched on a support surface, the spreaders 150 spread and open the ribs 140 to fully stretch the canopy of the tent.

However, the canopy tent having such a conventional automatic umbrella-type collapsible frame is problematic due to structural defect of the frame as follows.

That is, when it is desired to collapse the tent, the shank 110 must be connected to the externally-threaded lower end 121 of the rib holder 120 through a screw-type engagement so as to allow the spreader holder 130 to be fully movable downward along the shank 110. It is also necessary to remove the shank 110 from the rib holder 120 and to separately, carefully keep the shank 110 after the tent is completely pitched on a support surface since the shank 110 may disturb persons inside the pitched tent. Therefore, the frame does not allow a user to easily, simply or quickly pitch or close the canopy tent, in addition to causing a problem of separately keeping the shank 110 removed from the frame of the fully pitched tent.

The tension of the tent in a fully pitched position is supported only by the engagement of the retractable bolt 122 with the actuating button 131, and so the bolt 122 and button 131 are overloaded to be easily broken. When at least one of the bolt 122 and button 131 is broken as described above, it is impossible to pitch or close the tent. In such a case, it is necessary to repair the broken bolt 122 or button 131; otherwise, the owner of the tent is forced to purchase a new tent.

Another problem experienced by the conventional automatic umbrella-type frame for canopy tents resides in that it is difficult to move the spreader holder 130 along the shank 110 and the shank part of the rib holder 120 when pitching or closing the tent. That is, since the canopy tent with such an automatic umbrella-type frame is large in its size and heavy in its weight, different from conventional automatic umbrellas, it is difficult to move the spreader holder 130.

SUMMARY OF THE INVENTION

Accordingly, the present invention has been made keeping in mind the above problems occurring in the prior art, and an object of the present invention is to provide a canopy tent, which is provided with an automatic umbrella-type collapsible frame designed to be easily and simply stretched or collapsed in the same manner as expected from the collapsible frames of conventional automatic umbrellas so as to allow a user to easily and simply pitch or close the tent, and of which the frame has a spring fitted over the shank part of the rib holder, the spring having high restoring force and automatically stretching the ribs, thus allowing a user to easily, simply and quickly pitch or close the tent, in addition to simplifying the construction of the frame.

In order to accomplish the above object, the present invention provides a canopy tent, comprising: a collapsible frame operated in a manner similar to that of the frames of conventional automatic umbrellas so as to pitch or close the tent, the frame including: a rib holder rotatably holding a plurality of collapsible ribs at its upper end while allowing the ribs to be stretchable in a radial direction when pitching the tent, with a stopper mounted to the lower end of the rib holder, and a rope connector integrally formed at the lower end of the rib holder and used for holding a tension rope extending from the center of the ceiling part of the tent's canopy; a spreader holder movably fitted over the shank part of the rib holder such that the spreader holder is movable upward and downward along the shank part, the spreader holder rotatably holding a plurality of collapsible spreaders while allowing the spreaders to be stretchable in a radial direction when pitching the tent, the spreaders being also hinged to the ribs respectively; and an elastic spring fitted over the shank part of the rib holder, and used for biasing the spreader holder so as to maintain a predetermined gap between the spreader holder and the top end of the rib holder when pitching the tent.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
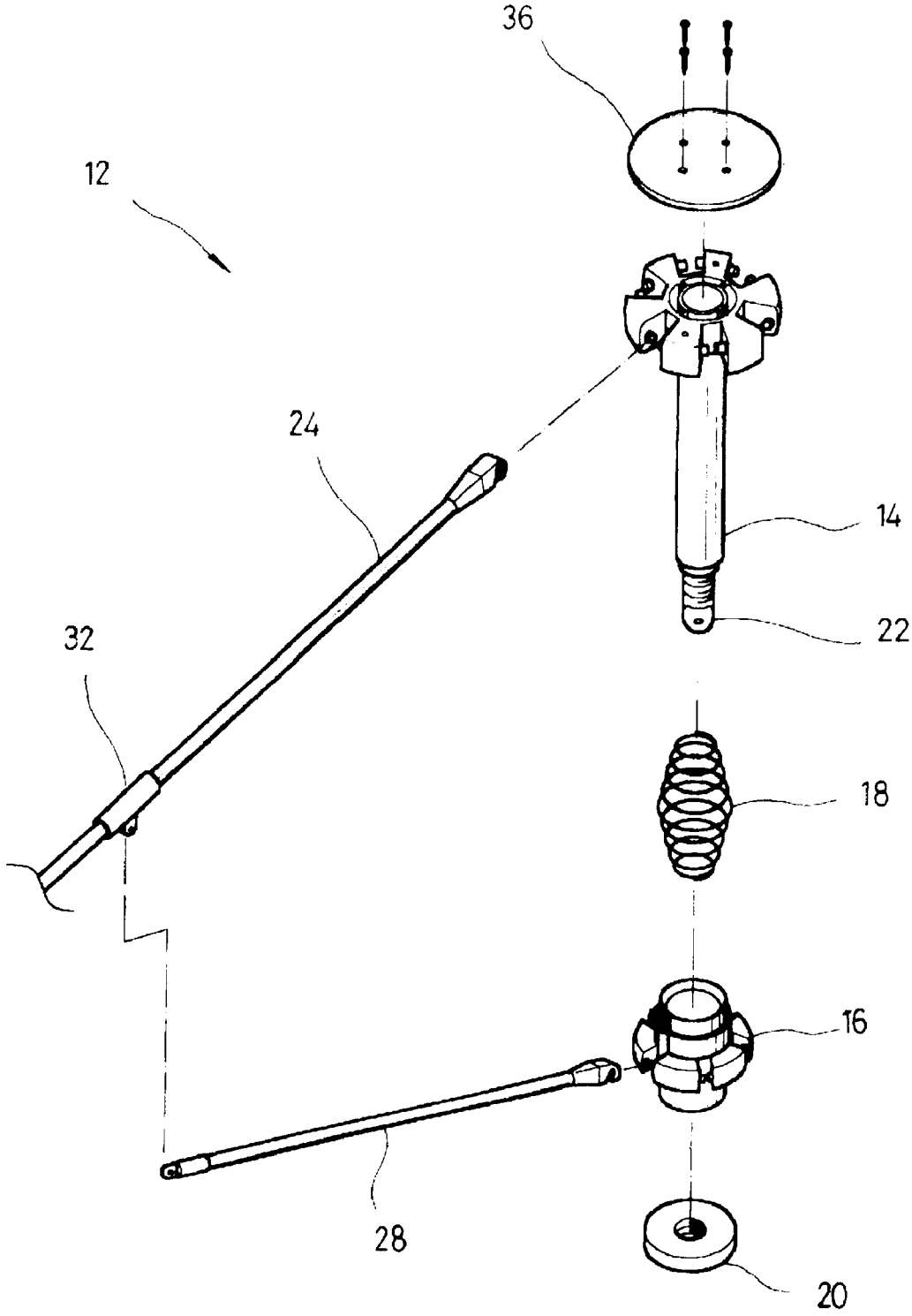
FIG. 1 is an exploded perspective view, showing the construction of the automatic umbrella-type collapsible frame of a canopy tent in accordance with the primary embodiment of the present invention.

Reference now should be made to the drawings, in which the same reference numerals are used throughout the different drawings to designate the same or similar components.

FIG. 1 is an exploded perspective view, showing the construction of the automatic umbrella-type collapsible frame of a canopy tent in accordance with the primary embodiment of the present invention.

As shown in the drawing, the collapsible frame 12 of the tent 10 according to the primary embodiment of this invention comprises a rib holder 14, a spreader holder 16, an elastic spring 18, a plurality of collapsible ribs 24 and a plurality of collapsible spreaders 28.

The rib holder 14 rotatably holds the collapsible ribs 24 at its upper end while allowing the ribs 24 to be stretchable in a radial direction when pitching the tent 10. A stopper 20 is mounted to the lower end of the rib holder 14, while a rope connector 22 is integrally formed at the lower end of the rib holder 14 and is used for holding a tension rope extending from the center of the ceiling part of the tent's canopy.

The spreader holder 16 is movably fitted over the shank part of the rib holder 14 such that the spreader holder 16 is movable upward and downward along the shank part of the rib holder 14. The spreader holder 16 rotatably holds the collapsible spreaders 28 while allowing the spreaders 28 to be stretchable in a radial direction when pitching the tent 10. The spreaders 28 are also hinged to the ribs 24, respectively.

An elastic spring 18 is fitted over the shank part of the rib holder 14, and is used for biasing the spreader holder 16 so as to maintain a predetermined gap between the spreader holder 16 and the top end of the rib holder 14 when pitching the tent 10.

The operational effect of the canopy tent 10 according to the primary embodiment of this invention will be described herein below.

Figure 2:
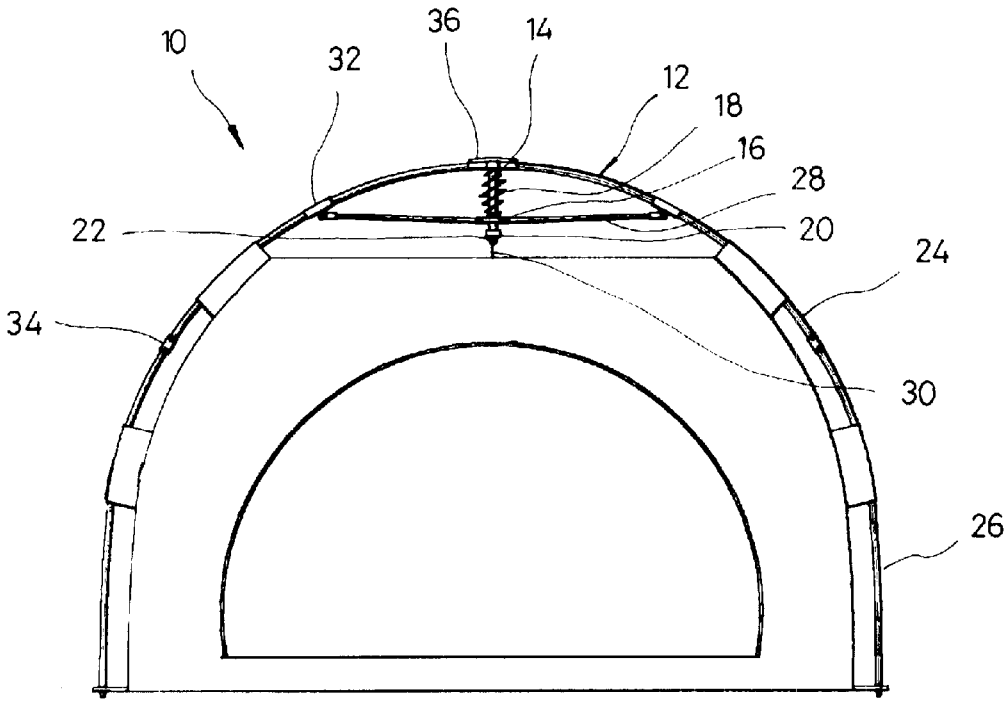
FIG. 2 is a front view of the canopy tent according to the primary embodiment of this invention when the tent is fully pitched with the stretched frame.
Figure 3:
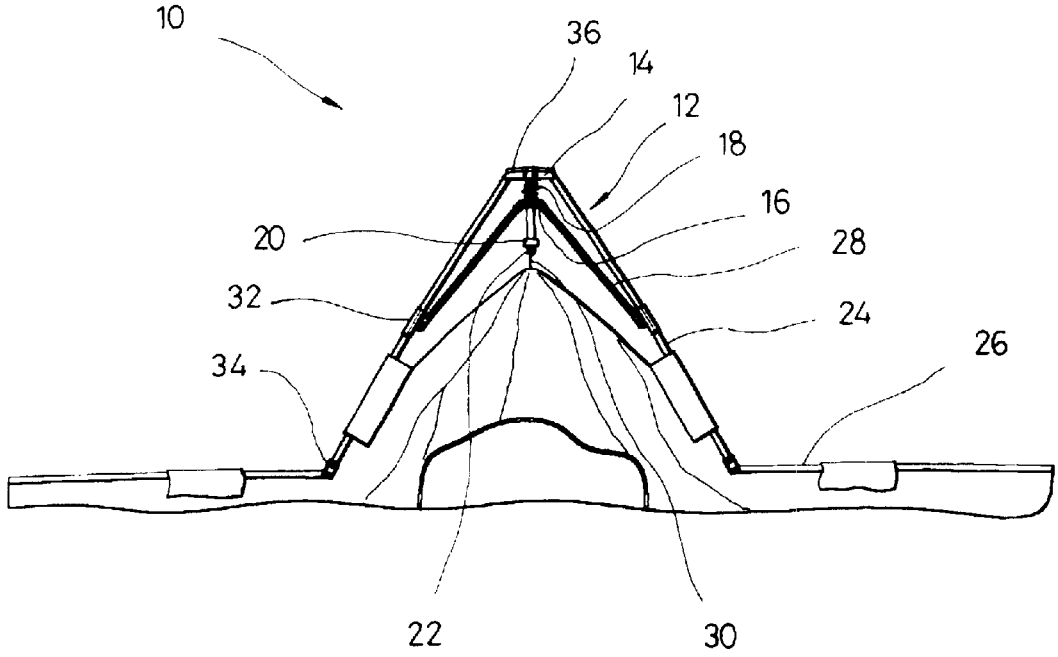
FIG. 3 is a front view of the canopy tent according to the primary embodiment of this invention when the tent is closed with the collapsed frame.

FIG. 2 is a front view of the canopy tent according to the primary embodiment of this invention when the tent is fully pitched with the stretched frame. FIG. 3 is a front view of the canopy tent according to the primary embodiment of this invention when the tent is closed with the collapsed frame.

When it is desired to close the pitched tent 10 as shown in FIG. 3, a user primarily holds any two diametrically opposite ribs 24 at portions around the joints 34 of the ribs 24 and their extensions 26, and forces the selected two ribs 24 inward and downward while overcoming tensile force of the stretched ribs 24. When the selected two ribs 24 are forced by the user as described above, the entire ribs 24 are rotated downward around the hinged joints of the ribs 24 and the rib holder 14, thus being closed at the same time.

When the entire ribs 24 are closed as described above, the ribs 24 and the rib holder 14 are pushed downward by the user in a vertical direction to reach a lower position. Thereafter, the extensions 26 are fully folded upward around the joints 34, thus completely collapsing the tent 10.

During such a tent collapsing action, the spreader holder 16, movably fitted over the shank part of the rib holder 14, is moved upward along said shank part as it is forced upward by the spreaders 28 hinged to the ribs 24. The spreader holder 16 thus reaches an upper position on the rib holder 14.

In such a case, the spreader holder 16 compresses the spring 18 during its upward movement along the shank part of the rib holder 14.

When it is desired to pitch the tent 10 as shown in FIG. 2, the user primarily opens the folded extensions 26 from the closed ribs 24, and holds any two diametrically opposite ribs 24 at portions around the joints 34 prior to forcing the selected two ribs 24 upward and outward. When the selected two ribs 24 are forced by the user as described above, the entire ribs 24 are rotated upward around the hinged joints of the ribs 24 and the rib holder 14 to be fully opened at a time the outward force applied from the user to the ribs 24 overcomes the restoring force of the spring 18. Thus, the tent 10 is fully pitched.

During such a tent pitching action, the spreader holder 16, movably fitted over the shank part of the rib holder 14, is moved downward along the shank part by the restoring force of the spring 18. In such a case, the downward movement of the spreader holder 16 along the rib holder 14 stretches the spreaders 28. Such a stretching action of the spreaders 28 also promotes the stretching action of the ribs 24.

Figure 4A:
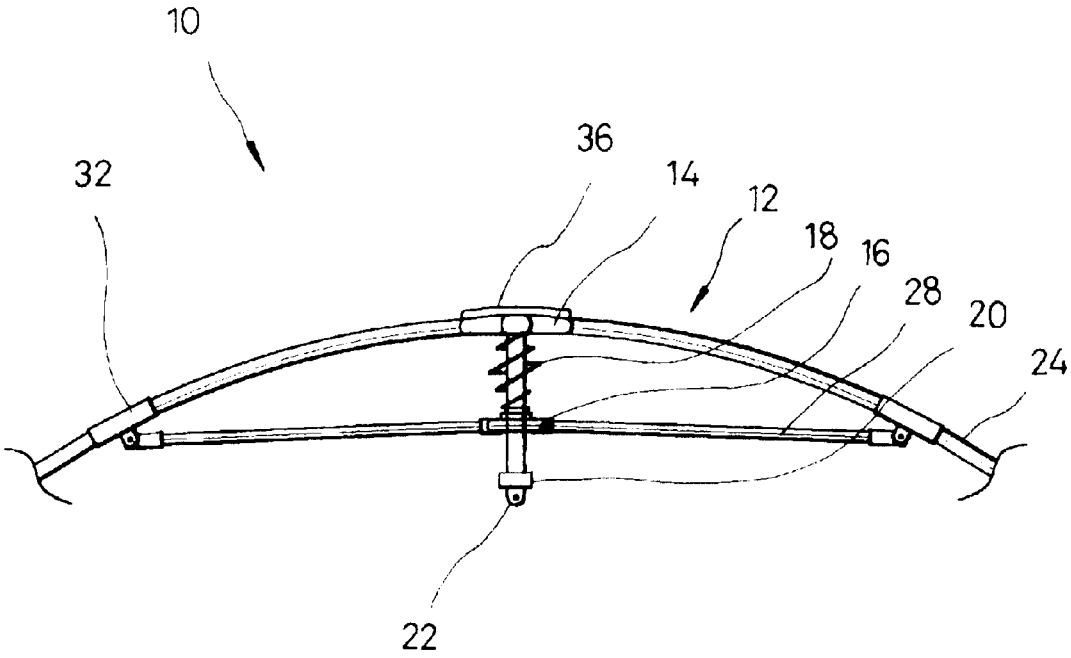
FIGS. 4*a* and 4*b* are front views of the automatic umbrella-type collapsible frame of the tent according to the primary embodiment of this invention, showing the operation of the upper portion of the frame.
Figure 4B:
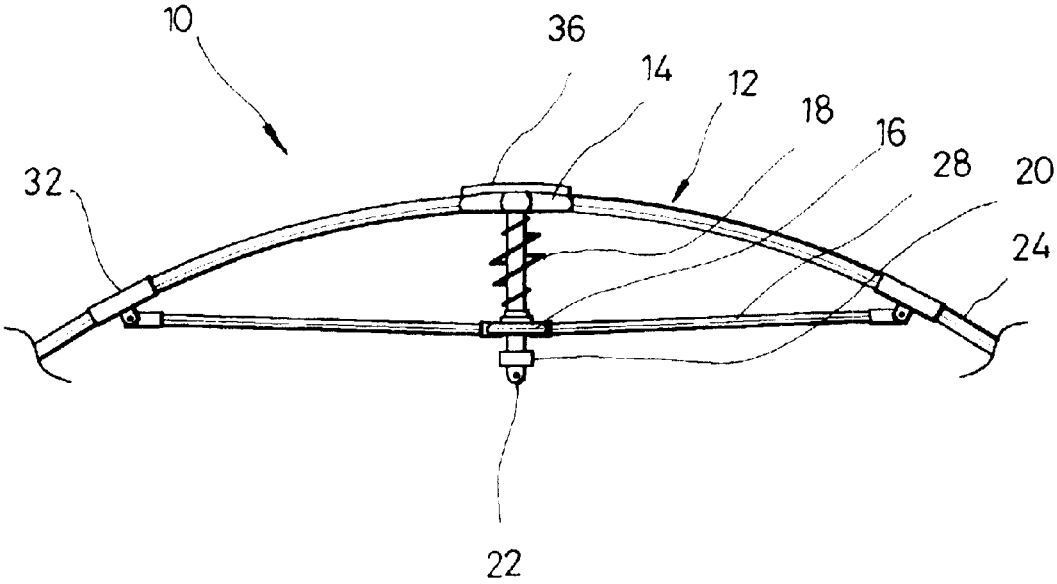

FIGS. 4*a* and 4*b* are front views of the automatic umbrella-type collapsible frame 12 of the tent 10 of this invention, showing the operation of the upper portion of the frame 12. As shown in the drawings, the hinged structure of the spreaders 28 and the spreader holder 16 is designed to retain the frame 12 in its fully stretched position without allowing the stretched frame 12 to be undesirably collapsed due to unexpected external impact applied to the frame 12.

When the frame 12 of the tent 10 is fully stretched as shown in FIG. 4*a,* the outside ends of the spreaders 28 hinged to the slidable spreader connectors 32 are positioned slightly lower than the inside ends of the spreaders 28 hinged to the spreader holder 16. That is, the spreaders 28 in the above position are slightly inclined downward in a direction from their inside ends to outside ends.

In such a case, it is possible for the frame 12 to retain the tent 10 in the above-mentioned position by the restoring force of the spring 18. However, when external force is applied to the tent 10 in the fully pitched position, the frame 12 may fail to retain the position of the pitched tent 10, but is collapsed to undesirably close the tent 10.

However, the frame 12 of this invention is designed to retain the position of the pitched tent 10 irrespective of external impact undesirably applied to the tent 10. That is, when a user applies pressure to the spreader holder 16 so as to slightly move the spreader holder 16 downward along the shank part of the rib holder 14 after the frame 12 is fully stretched, the position of the spreaders 28 is changed such that the outside ends of the spreaders 28 are positioned slightly higher than the inside ends of the spreaders 28 as shown in FIG. 4*b*. That is, the spreaders 28 in the above position are slightly inclined downward in a direction from their outside ends to inside ends. At the above position, the frame 12 effectively retains the pitched position of the tent 10 irrespective of external impact undesirably applied to the tent 10.

That is, when a user applies downward pressure to the spreader holder 16 after the frame 12 is fully stretched, the spreader holder 16 is moved downward along the shank part of the rib holder 14 due to both the pressure applied from the user and the restoring force of the elastic spring 18, thus reaching a predetermined position on the shank part of the rib holder 14.

At the above-mentioned position of the spreader holder 16, the inside ends of the spreaders 28 hinged to the spreader holder 16 are positioned lower than the outside ends of the spreaders 28 hinged to the connectors 32. The spreaders 28 are thus inclined downward in the direction from their outside ends to their inside ends.

The spreaders 28 in the above-mentioned position reliably retain the frame 12 in its fully stretched position while allowing the frame 12 to resist undesired external impact applied to the tent 10.

Figure 5:
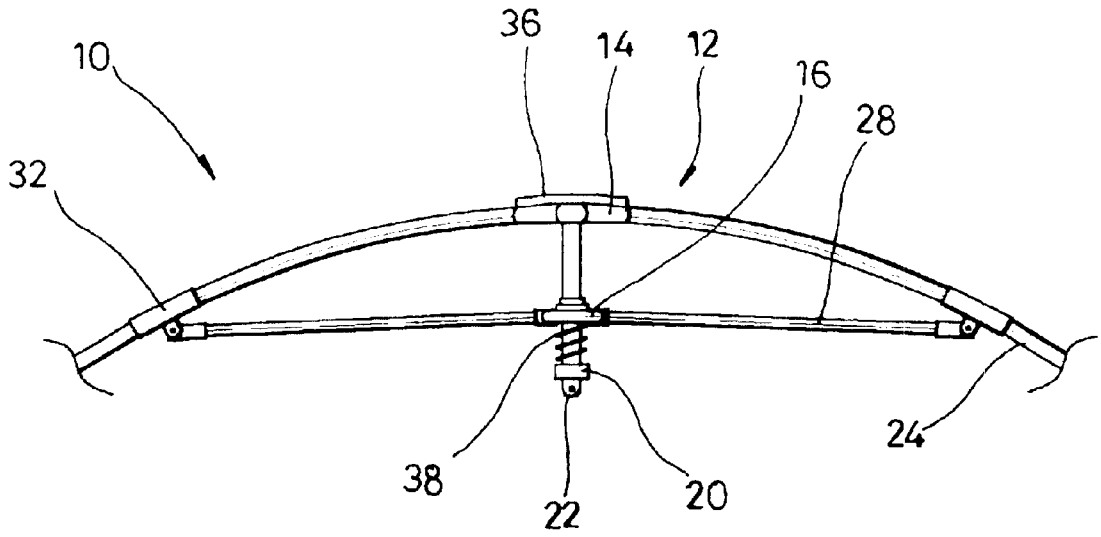
FIG. 5 is a front view of the automatic umbrella-type collapsible frame of a canopy tent according to another embodiment of the present invention, showing the operation of the upper portion of the frame.
Figure 6:
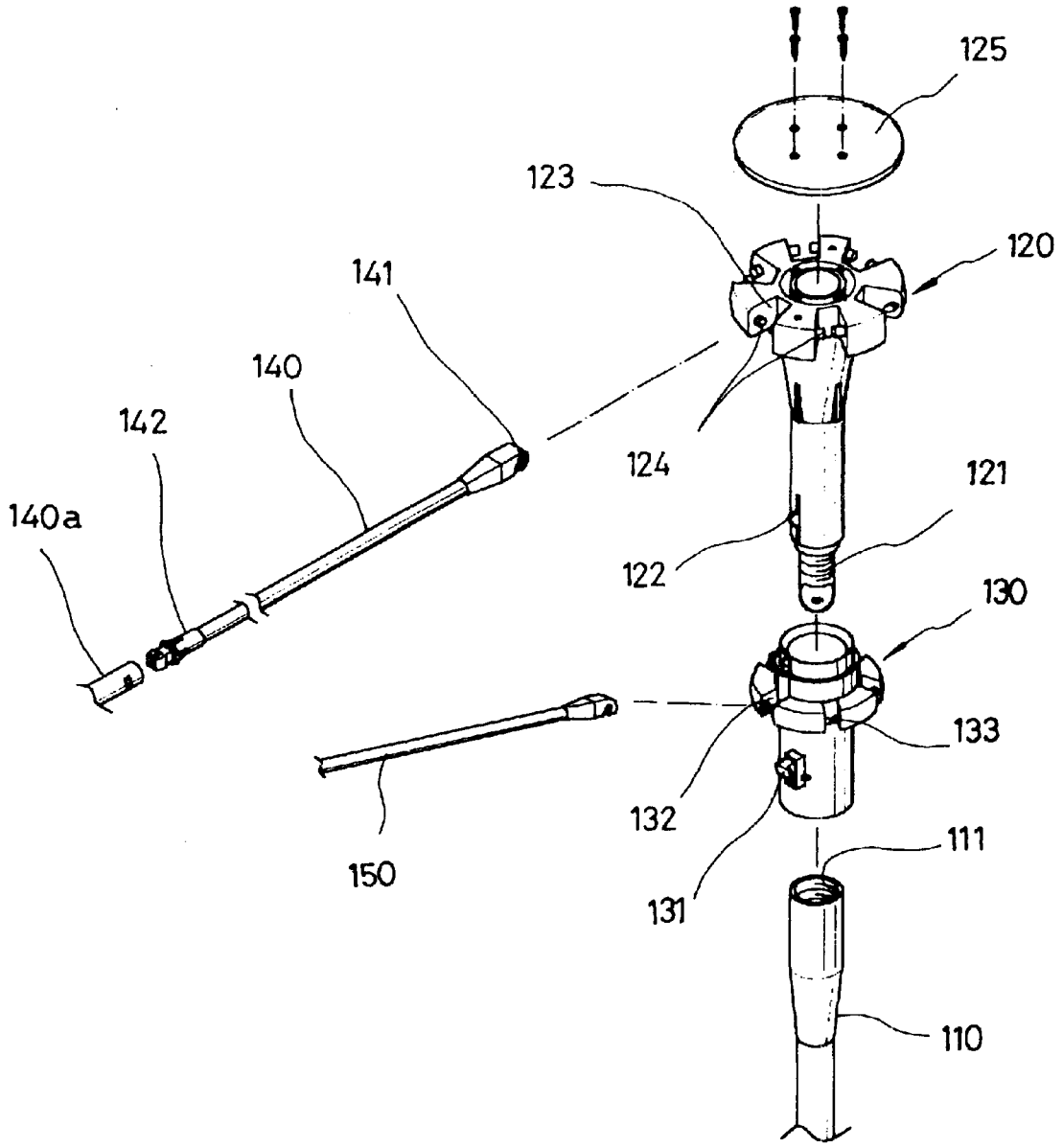
Fig. 6 Prior Art
FIG. 6 is an exploded perspective view, showing the construction of the automatic umbrella-type collapsible frame of a conventional canopy tent.

FIG. 5 is a front view of the automatic umbrella-type collapsible frame of a canopy tent according to another embodiment of the present invention. As shown in the drawing, the general shape of the collapsible frame 12 of the canopy tent 10 according to this embodiment remains the same as that described for the primary embodiment, but the position of the elastic spring is altered as follows. That is, the spring 38 is positioned between the spreader holder 16 and the stopper 20, different from the spring 18 of the primary embodiment, positioned between the spreader holder 16 and the top end of the rib holder 14. The spring 38 biases the spreader holder 16 so as to maintain a predetermined gap between the spreader holder 16 and the stopper 20 when pitching the tent 10. The frame 12 according to this embodiment yields the same operational function as that of the primary embodiment, and further explanation is thus not deemed necessary.

As described above, the present invention provides a canopy tent with an automatic umbrella-type collapsible frame. The collapsible frame of the canopy tent according to the invention is designed to be easily and simply stretched or collapsed in the same manner as expected from the collapsible frames of conventional automatic umbrellas, thus allowing a user to easily and simply pitch or close the tent. In the frame of this invention, a spring having high restoring force is fitted over the shank part of the rib holder, and automatically stretches the ribs, thus allowing the user to easily, simply and quickly pitch or close the tent, in addition to simplifying the construction of the frame.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A canopy tent, comprising a collapsible frame configured to pitch or close the tent, said frame including:

a rib holder having an upper end, a lower end, and a shank part extending between the upper and lower ends;

said rib holder pivotally holding a plurality of collapsible ribs at its upper end while allowing the ribs to be stretchable in a radial direction when pitching the tent, with a stopper mounted to the lower end of said rib holder, and a rope connector integrally formed at the lower end of the rib holder and used for holding a tension rope extending from a center of a ceiling part of a tent's canopy;

a spreader holder movably fitted over said shank part of said rib holder such that the spreader holder is movable upward and downward along said shank part, said spreader holder pivotally holding a plurality of collapsible spreaders while allowing the spreaders to be stretchable in a radial direction when pitching the tent, said spreaders being also hinged to said ribs respectively; and an elastic spring fitted over said shank part of the rib holder, and used for biasing the spreader holder away from the upper end so as to maintain a predetermined gap between the spreader holder and the upper end of said rib holder when pitching the tent.

2. The canopy tent according to claim 1, wherein, in response to pressure applied from a user to the spreader holder after the frame is fully stretched, said spreader holder is moved downward along the shank part of the rib holder due to both the pressure applied from the user and restoring force of said elastic spring, thus reaching a predetermined position where the spreader holder retains the frame in its fully stretched position while making the inside ends of the spreaders positioned lower than the outside ends of the spreaders.

3. The canopy tent, comprising a collapsible frame configured to pitch or close the tent, said frame including:

a rib holder having an upper end, a lower end, and a shank part extending between the upper and lower ends, said rib holder pivotally holding a plurality of collapsible ribs at its upper end while allowing the ribs to be stretchable in a radial direction when pitching the tent, with a stopper mounted to the lower end of said rib holder, and a rope connector integrally formed at the lower end of the rib holder and used for holding a tension rope extending from a center of a ceiling part of a tent's canopy;

a spreader holder movably fitted over said shank part of said rib holder such that the spreader holder is movable upward and downward along said shank part, said spreader holder pivotally holding a plurality of collapsible spreaders while allowing the spreaders to be stretchable in a radial direction when pitching the tent, said spreaders being also hinged to said ribs respectively; and an elastic spring biasing the spreader holder away from the upper end so as to maintain a predetermined gap between the spreader holder and the upper of said rib holder when pitching the tent.

4. A canopy tent comprising:

a tent canopy having a tent ceiling, the canopy defining an internal tent space when the tent is pitched;

a collapsible frame associated with the tent canopy to maintain the internal tent space when the tent is pitched, the frame comprising:

a rib holder having an upper end, a lower end and a shank portion;

a plurality of ribs pivotally coupled to and extending from the upper end of the rib holder;

a spreader holder slidably fitted over the shank portion of the rib holder such that the spreader holder is movable upward and downward along the shank portion;

an elastic spring fitted over the shank portion of the rib holder between the upper end of the rib holder and the lower end of the rib holder and configured to bias the spreader holder away from the top end of the rib holder when pitching the tent; and a connector integrally formed at the lower end of the rib holder and coupled to a center portion of the tent ceiling.

5. The canopy tent of claim 4, wherein the collapsible frame is configured such that the spreader holder is closer to the upper end of the rib holder than the lower end of the rib holder when the tent is in a closed position.

6. The canopy tent of claim 5, wherein the collapsible frame is configured such that the spreader holder is closer to the lower end of the rib holder than the upper end of the rib holder when the tent is pitched.

7. The canopy tent of claim 4, wherein the rib holder is above the tent ceiling and outside the internal tent space when the tent is pitched.

* * * * *